US007523941B2

(12) United States Patent
Thomas et al.

(10) Patent No.: US 7,523,941 B2
(45) Date of Patent: Apr. 28, 2009

(54) ACTIVE DEALER VERSION OF BLACKJACK

(76) Inventors: David Charles Thomas, 13811 W. 47th Ter., Shawnee, KS (US) 66216; Mark Jerome Koetting, 3246 W. 132nd Ter., Leawood, KS (US) 66209

( * ) Notice: Subject to any disclaimer, the term of this patent is extended or adjusted under 35 U.S.C. 154(b) by 242 days.

(21) Appl. No.: 11/486,628

(22) Filed: Jul. 14, 2006

(65) Prior Publication Data

US 2006/0279045 A1 Dec. 14, 2006

(51) Int. Cl.
*A63F 1/00* (2006.01)

(52) U.S. Cl. ..... 273/274; 273/292

(58) Field of Classification Search ..... 273/274, 273/292; 463/12, 13
See application file for complete search history.

(56) References Cited

U.S. PATENT DOCUMENTS 5,282,633 A * 2/1994 Boylan et al. ..... 273/306
5,454,570 A * 10/1995 Karal ..... 273/292
5,566,946 A * 10/1996 Parker ..... 273/292
5,636,842 A * 6/1997 Cabot et al. ..... 273/292
5,725,215 A * 3/1998 Hesse ..... 273/292
5,735,524 A * 4/1998 Wisted ..... 273/274
5,791,652 A * 8/1998 Nielsen ..... 273/305
5,806,846 A 9/1998 Lofink et al.
5,810,360 A * 9/1998 Srichayaporn ..... 273/292
5,820,128 A * 10/1998 Brunelle ..... 273/292
5,823,536 A 10/1998 Flasch
5,979,897 A 11/1999 Grossman
5,988,644 A * 11/1999 Cyrkiel ..... 273/292
6,102,402 A * 8/2000 Scott et al. ..... 273/292
6,182,968 B1 2/2001 Wilkinson
6,196,548 B1 * 3/2001 Schaefer ..... 273/292
6,302,396 B1 10/2001 Eaton et al.
6,375,188 B1 * 4/2002 Painter et al. ..... 273/292
6,406,023 B1 6/2002 Rowe
6,485,020 B1 * 11/2002 Broadnax ..... 273/292
6,511,070 B1 * 1/2003 Daines ..... 273/292
6,543,773 B2 * 4/2003 Mims ..... 273/292

(Continued)

OTHER PUBLICATIONS

Hoyles Modern Encyclopedia of Card Games, by Walter B. Gibson, New York, Dolpin Books Doubleday & Co., Inc, Blackjack, pp. 32-35, 1974.*

(Continued)

*Primary Examiner*—William M Pierce
(74) *Attorney, Agent, or Firm*—Brian B. Diekhoff; Polsinelli Shugart PC

(57) ABSTRACT

This invention relates to a method of playing a modified version of blackjack wherein the dealer is an active rather than a passive participant. The dealer selects which of the two dealer initial cards to turn face-up for exposure to the other players. The dealer also elects whether to surrender or play the hand that is dealt. The dealer further may opt to take additional cards on any "soft" hand and is not forced to stand on a losing hand. Additional modifications to the standard game of blackjack which increase the role of strategy and skill as well as increase the excitement of the game relate to doubling up which includes removing the limit on the number of cards that a player may take after placing an additional wager and removing the limit on the amount by which the initial wager may be increased.

24 Claims, 7 Drawing Sheets

U.S. PATENT DOCUMENTS

| | | | | |
|---|---|---|---|---|
| 6,637,747 | B1 * | 10/2003 | Garrod | 273/292 |
| 6,644,666 | B1 * | 11/2003 | Tamura et al. | 273/292 |
| 6,752,395 | B2 * | 6/2004 | Jones et al. | 273/292 |
| 6,805,353 | B2 * | 10/2004 | Williams | 273/292 |
| 6,869,077 | B1 | 3/2005 | Ozmulla et al. | |
| 6,877,748 | B1 | 4/2005 | Patroni et al. | |
| 6,959,927 | B1 | 11/2005 | Jacobs et al. | |
| 6,988,732 | B2 | 1/2006 | Vancura | |
| 6,994,345 | B2 | 2/2006 | Henry | |
| 7,004,834 | B2 | 2/2006 | Walker et al. | |
| D519,164 | S | 4/2006 | Austin | |
| 7,022,015 | B2 | 4/2006 | Mostashari | |
| 7,033,276 | B2 | 4/2006 | Walker et al. | |
| 7,036,821 | B2 | 5/2006 | Hall | |
| 7,040,625 | B1 | 5/2006 | D'Avanzo | |
| 7,048,274 | B2 | 5/2006 | Duncombe et al. | |
| 7,048,275 | B2 | 5/2006 | Adams | |
| 7,052,392 | B2 | 5/2006 | Tessmer et al. | |
| 7,056,205 | B2 | 6/2006 | Odom et al. | |
| 7,086,943 | B2 * | 8/2006 | Mugnolo et al. | 463/12 |
| 2003/0168808 | A1 * | 9/2003 | Jones et al. | 273/292 |
| 2004/0090003 | A1 * | 5/2004 | Snow | 273/274 |
| 2004/0092301 | A1 * | 5/2004 | Williams | 463/16 |
| 2005/0127606 | A1 * | 6/2005 | Snow et al. | 273/292 |
| 2005/0212213 | A1 * | 9/2005 | Inglese | 273/292 |
| 2006/0091607 | A1 * | 5/2006 | Javier | 273/292 |
| 2006/0186600 | A1 * | 8/2006 | Sklansky et al. | 273/292 |
| 2007/0099686 | A1 * | 5/2007 | Webb | 463/12 |
| 2007/0145684 | A1 * | 6/2007 | Webb et al. | 273/292 |
| 2007/0241501 | A1 * | 10/2007 | Kling et al. | 273/292 |

OTHER PUBLICATIONS

International Search Report for PCT/US07/15700 dated Nov. 17, 2008, 3 pages.

* cited by examiner

ACTIVE DEALER VERSION OF BLACKJACK

CROSS-REFERENCE TO RELATED APPLICATIONS

Not Applicable.

STATEMENT REGARDING FEDERALLY SPONSORED RESEARCH OR DEVELOPMENT

Not applicable.

BACKGROUND OF THE INVENTION

This invention relates generally to the field of gaming. In particular, the invention is directed to a method of playing a modified version of blackjack wherein the dealer takes an active rather than a passive role in the game, having the ability to strategize and make decisions affecting the other players.

Card games are very popular in a casino setting, in a tournament setting, and also in a private party or home setting. The game of blackjack, in particular, is a highly popular game. Standard blackjack is a fairly uncomplicated game and may be played "live" in casinos, tournaments or at home, or may be played in electronic form either on-line or via video screen.

The standard game of blackjack is played with a standard deck of 52 cards (excluding the Jokers). The object of the game is to draw a hand having a value (a card sum or card point total) as close to 21 as possible without going over 21. Numbered cards are valued at their face value, face cards count as 10, and aces count as either 1 or 11. Typically, there is a house dealer who deals every hand and does not participate in making a wager. In standard blackjack, each player makes a wager and then receives two cards, either face-up or face-down. The player may look at any of his face-down cards. The dealer also receives two cards, one face-up and one face-down. The dealer is not permitted to choose which card will be face-up. If the dealer has a blackjack—a total of 21—in the first two cards dealt, the house wins and the player loses his wager. If the player also has a blackjack, the hand is a push between the dealer and that player and the player keeps his or her wager. If the dealer does not have a blackjack, the player may stand on the cards he or she has or take a hit—elect to be dealt another card. The player may continue taking additional cards—trying to come as close to 21 as possible without busting (going over 21). Once all players have taken their desired number of cards, the dealer reveals his cards and if the total is less than 17, the dealer must take another card. If the dealer has 17 or higher, he must stand—the dealer has no discretion in deciding whether to play the hand or whether to hit or stand. If the player has a higher total than the dealer without going over 21, the player wins and is paid 1:1 according to his wager. If the player and the dealer have the same valued hand, the hand is a push between the dealer and that player and the player retains his wager. If the player goes over 21 or is under 21 but also has a hand which is further away from 21 than the dealer, the player loses his or her wager. If the player has a blackjack and the dealer does not, the player is paid 3:2 according to his wager. If the player is initially dealt a pair, he may elect to split them into two hands by placing a new bet on the new hand. The new hand is played in the same manner as the first—with the player being able to take as many cards as desired. In addition, a player may also double-down on the originally-dealt two cards by placing a second bet, up to the value of the initial bet. When a player doubles-down, however, the player must take one and only one card and then stand on the hand.

In standard blackjack, while a player makes the decision to split or double-down, as well as whether to take another card or stand, chance or "the luck of the draw" plays a significant part in determining who wins and who loses. The dealer, on the other hand, is not an active participant in the game and does not make any decisions as to whether to play the hand or take a hit. In some games, the role of the "dealer" rotates among the players such that each player has a turn in being a passive non-wagering participant. In other games, while the dealer may be a house or casino dealer, the role of the "banker" rotates among the players. In both of these variations, however, the dealer or banker remains a passive participant and must strictly adhere to the standard rules of blackjack—leaving no decisions up to the dealer. For experienced players, these limitations on the standard game of blackjack may result in predictability and boredom.

Accordingly, a card game is needed that remains fairly uncomplicated in terms of general rules but that challenges experienced players and infuses additional elements of strategy into the game.

BRIEF SUMMARY OF THE INVENTION

The present invention provides a variant of the standard game of blackjack, wherein the dealer takes an active decision-making role in the game. In order to increase interest in the game and to decrease the effect of chance and render the game more skill-based, the present invention provides the added element of an active dealer wherein the dealer can select which card to expose, whether to surrender or play the hand, and whether to hit or stand on a particular hand. In addition, the present invention allows players to take more than one card, even after the players increase their initial bets by more than double the initial wager amount ("doubling up"). The present invention also encourages card counting by revealing all cards dealt after each hand.

In a preferred embodiment, the card game includes providing at least one standard deck of 52 playing cards wherein each card in the deck has a specific numeric value. There is at least one player and one dealer and each player, except the dealer, makes a blind wager prior to the dealing of any cards. The blind wager is a 1, 2, or 3 times multiple of an established minimum bet. An initial hand of two cards each is dealt to each player and the dealer, the player's cards being dealt one face-up and one face-down and the dealer's cards both being dealt face-down. The dealer looks at the dealer face-down cards and selects which of the two cards to turn face-up. Each player then declares their hand as a surrender, a playing hand or an increased wager hand, wherein the player must make an additional wager. If a player surrenders, the player loses half of their blind wager to the dealer and folds the hand. After each player has declared their hand, the dealer declares the dealer's hand as either a surrender or a playing hand.

If the dealer surrenders, the dealer pays half of each remaining player's blind wager to that player. If a player has a blackjack, the dealer pays the player on their blind wager according to pre-set odds. If the dealer plays the hand, the dealer deals additional cards to each player upon the respective player's request, wherein each player elects, in turn, to stand or receive additional cards one at a time until the player elects to receive no more or until the card sum exceeds 21. The final number of cards held by each player comprises that respective player's hand. If the card sum of any player's hand exceeds 21, that player forfeits their wager and withdraws from play. After all player hands have been resolved, the dealer draws additional cards if the initial card sum of the dealer's hand is less than 17 and does not contain an ace valued at 11 (e.g. if the hand has no ace or an ace valued at 1 and the hand is less than 17, the dealer must take a card). The dealer may elect to take additional cards, but is not required to do so, regardless of the value of the hand if the dealer has an ace valued at 11 (e.g. a "soft" hand). The dealer must stand and cannot take an additional card if the dealer's card sum is 17 or more and the hand does not contain an ace valued at 11. If, however, there is only the dealer and one player remaining in the game, the dealer may draw additional cards on any losing hand even if the card sum is 17 or greater and the hand does not contain an ace valued at 11, but the dealer must stand on a tie with the player.

After the dealer has drawn all desired cards, the card sum of each player's hand is compared to the card sum of the dealer's hand. A player has a winning hand if the card sum is 21 and the dealer card sum is not 21 or if the player card sum is less than 21 and closer to 21 than the card sum of the dealer's hand or if the player card sum is equal to or less than 21 and the dealer card sum exceeds 21. A player has a losing hand if the card sum exceeds 21 or is further from 21 than the card sum of the dealer's hand, and a player ties with the dealer where the card sum of the player's hand is equal to the card sum of the dealer's hand. The dealer collects the losing player's wagers and pays out winnings to the winning players based on the wagers made. Wagers are returned to the player if the player has a push with the dealer. The betting structure and certain rules vary from the standard casino format to give players more options to improve their hands and reward skill by moving chips to the better players. Card counting is encouraged and long term strategy can reduce the importance of luck in determining the winner.

In contrast to the present invention, the initial bet in the standard game of blackjack is within a range which is preset by the casino and, while there may be a table limit, the players may bet any amount within the allowable range and are not limited to multiples of a minimum bet. Most importantly, the dealers in standard blackjack are not active and do not exercise any decision-making power—they must adhere to strictly dictated rules of play. In standard blackjack, there is also a limit on taking only one card after "doubling-down" and in making that additional bet, the player may only bet up to the initial bet—not more. In standard blackjack, the decision to "double down" or split is made directly after the hands are dealt and each hand is resolved in turn—there is no "wager adjustment round" as in the present invention where players may otherwise increase their wager. In standard blackjack, the dealer also cannot choose to surrender in lieu of playing the hand and cannot select which card to flip. Further, the dealer in standard blackjack cannot hit on a soft hand over 17 and, depending on local custom or house rules, may not hit a "soft 17" at all. Lastly, in standard blackjack, there is no requirement that the cards be turned up after the hand is completed and card counting is not encouraged—it is highly discouraged. The term "card counting" may be considered colloquial and generally refers to various systems wherein players attempt to keep track of the proportion of "10 value" cards compared to the rest of the deck. A larger number of remaining "10 value" cards tends to favor the player while a larger number of lower value cards favors the dealer.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

The invention is a method for playing a modified blackjack card game suitable for casino-play, tournament-play, or private-play by multiple players and requiring no house dealer. The game is tournament and open play blackjack, pitting the players against each other instead of the house. A basic assumption in the present invention is that the game is a table stakes game such that a player can only bet what is on the table at the time and can only buy additional chips for the next round. A player is out of the game and must leave the table when that player has no remaining chips. As with standard blackjack, the object of the modified game is to assemble a hand which is valued at 21 or below. A hand comprised of only two cards totaling 21 in value is called a "blackjack." Cards are counted according to face value, face cards are counted as ten (10) and aces are counted as one (1) or eleven (11), whichever is the more favorable hand. A hand in which the ace is counted as 11 is called a "soft" hand.

Figure 1:
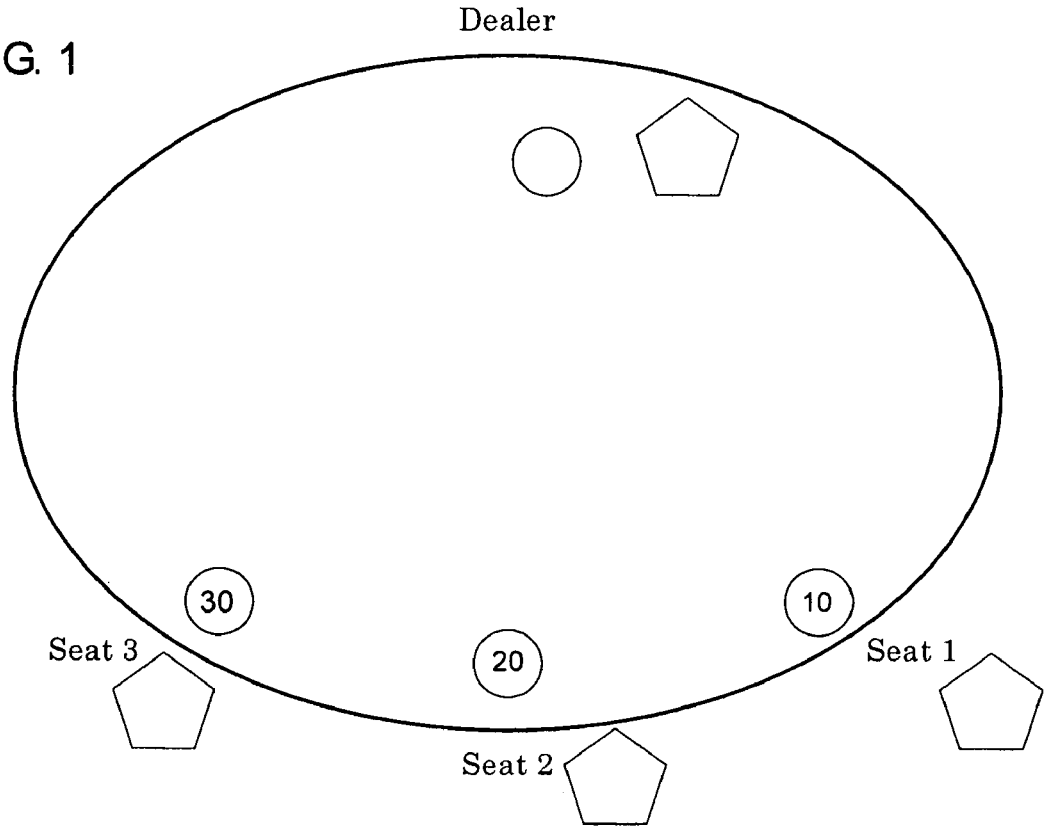
FIG. 1 is a visual representation exemplifying an initial wagering round in a preferred embodiment of the present invention.

A first player is designated as the dealer. The deal will pass to the next player, preferably in a clockwise direction, after each hand is completed. Other schedules or rules for passing the role of the dealer may also be employed as established by the house, host or tournament director. Although play preferably moves in a clockwise direction around the table, it is within the scope of the present invention for play to move in a counter-clockwise direction. The hand begins with the initial wager round and, as depicted in FIG. 1, each player places a blind bet prior to any cards being dealt. The blind bet is a multiple of a minimum bet set by the house, host, or tournament director. The blind bet may be 1×, 2× or 3× the minimum bet. A limit is imposed on the initial blind bet in order to ensure that the dealer is not forced to play because the surrender cost is too high. As is sometimes common in tournament play, the minimum blind bet may increase according to a set schedule. The dealer does not bet as he or she will be taking the other side of each hand.

Figure 2:
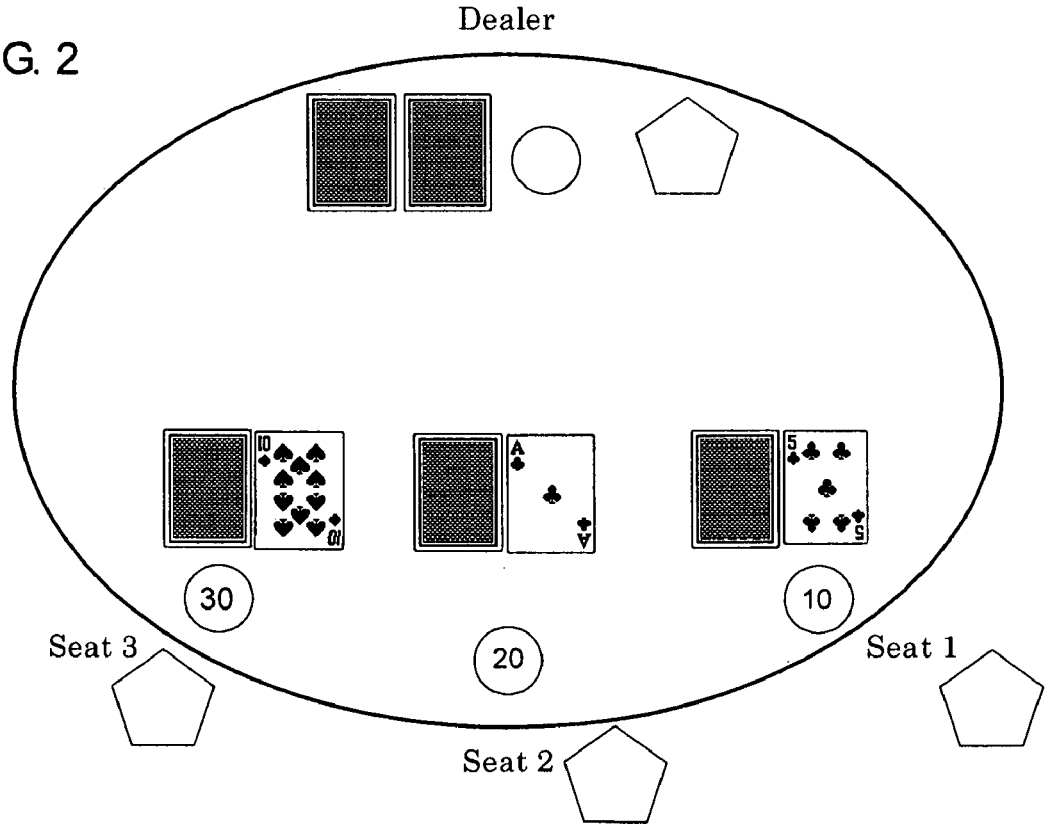
FIG. 2 is a visual representation exemplifying an initial deal in the preferred embodiment depicted in FIG. 1.

As shown in FIG. 2, each player receives one card face-up and one card face-down from the dealer. The dealer deals himself or herself two cards face-down. The dealer may deal one card at a time to each player and the dealer and then deal the second card in a second pass, or the dealer may deal both cards to each player and then to the dealer in succession—making only one pass around the table. Although it is preferred that the dealer deal one card face-up and one card face-down to each player, the dealer may also deal the player cards both face-up or both face-down. Alternatively, each player may be given the option either prior to the deal or after the deal of which card to receive face-up or to roll.

Figure 3:
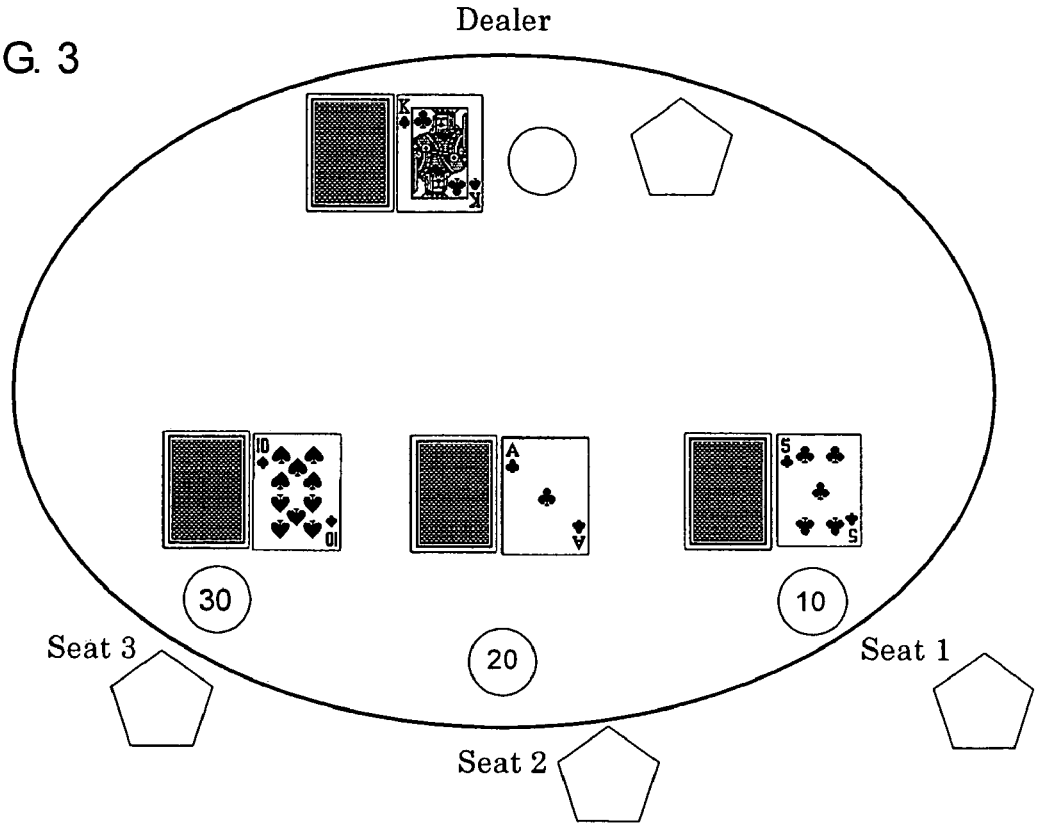
FIG. 3 is a visual representation exemplifying a dealer card roll in the preferred embodiment depicted in FIG. 1.

After the initial deal, the dealer preferably looks at his or her cards and makes the decision which card to roll so that the players can see the card, as shown in FIG. 3. The dealer choice allows the dealer to represent a weak hand or a strong hand by deciding which card to expose. Additionally, the card the dealer elects to expose is subject to interpretation by each player—this is not a factor in standard blackjack. The players may try to figure out the logic or strategy of the dealer's choice—the dealer may be bluffing or may be representing the true strength of the hand. If the dealer has a blackjack, it is revealed at this point and the dealer collects all of the bets unless a player also has a blackjack in which case the hand is a push as between the dealer and that player and the player retains his or her wager. If the dealer does not have a blackjack, the hand continues and the wager adjustment round begins.

Figure 4:
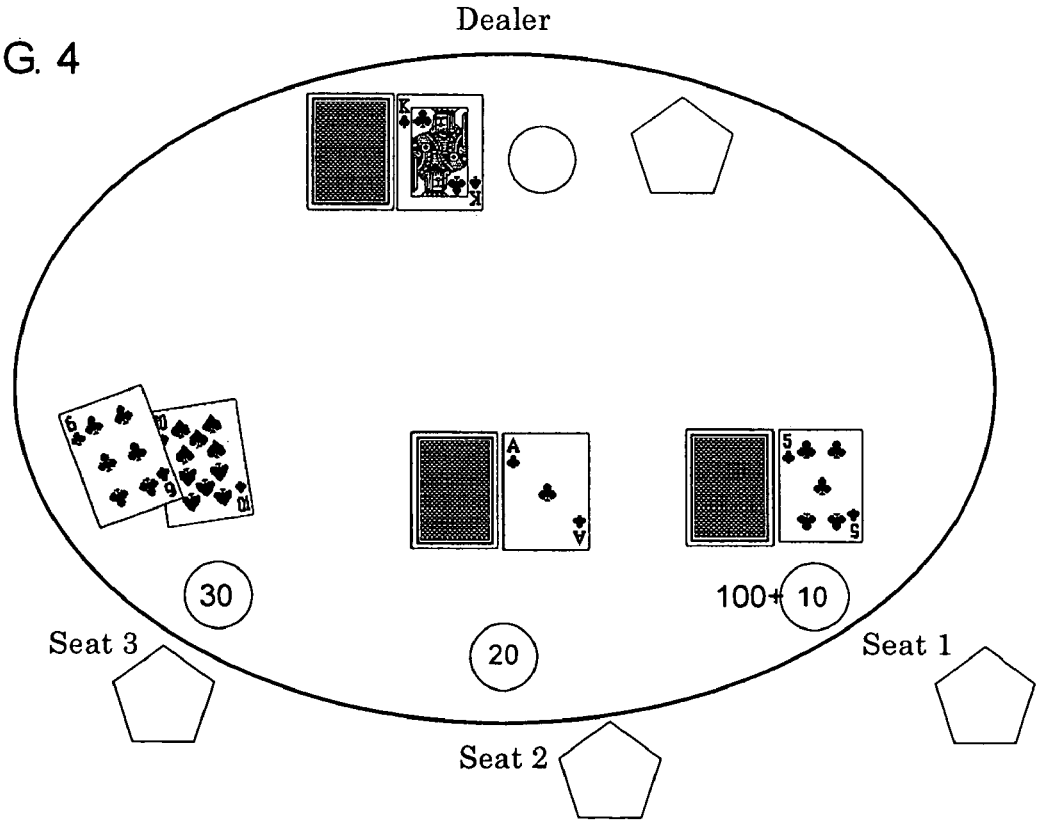
FIG. 4 is a visual representation exemplifying a player declaration stage occurring in the wager adjustment round in the preferred embodiment depicted in FIG. 1.
Figure 5:
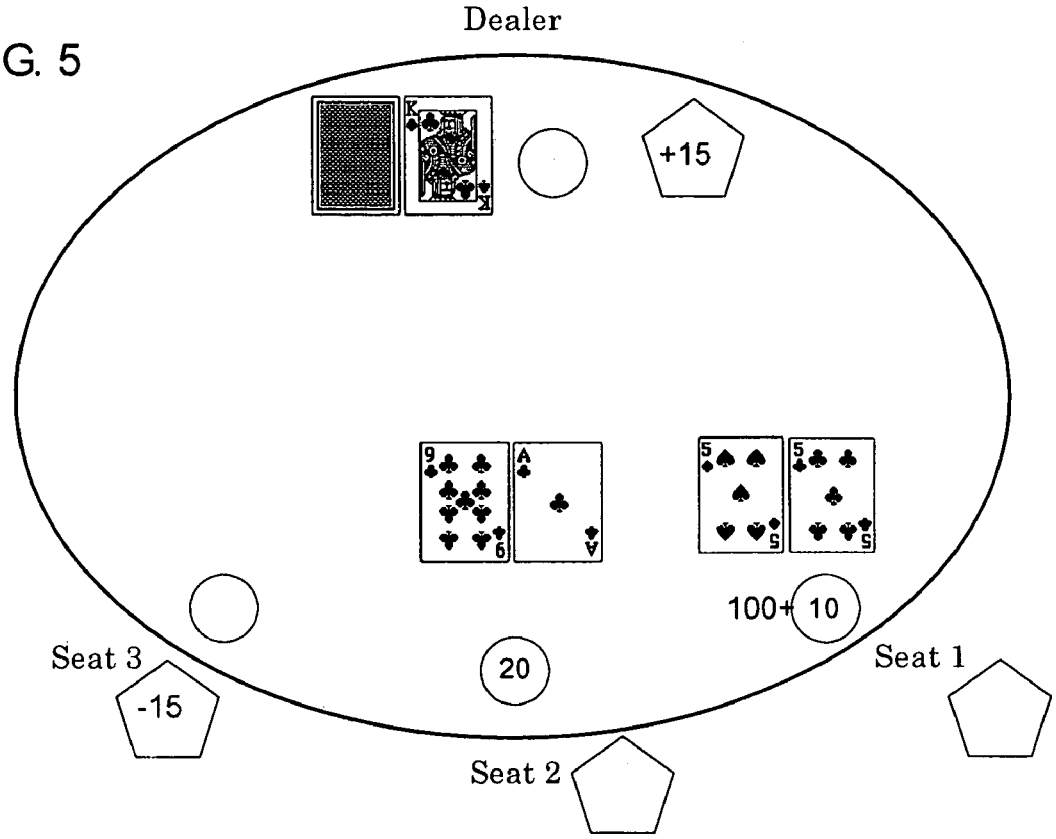
FIG. 5 is a visual representation exemplifying a wager allocation based on a player surrender during the player declaration stage in the preferred embodiment of FIG. 1.

Beginning preferably with the player immediately to the dealer's left, each player will look at his or her hidden card and announce their decision to play the hand in one of three ways, as depicted in FIGS. 4 and 5. The players may look at their down card at any time—as soon as they receive it or at a later time. It is also within the scope of the present invention to have a first player reveal, declare and play their hand before the other players reveal, declare and play their hands or to have all players reveal their cards at the same time—depending on the house, host or tournament rules.

First, as shown by Seat 3 in FIGS. 4 and 5, the player may surrender the hand by relinquishing half of their blind bet to the dealer and folding the hand. Second, as shown by Seat 2 in FIGS. 4 and 5, the player may decide to play the blind bet. The bet can be played without limitation, meaning that the player may take as many cards as desired. Third, as shown by Seat 1 in FIGS. 4 and 5, the player may choose to adjust the wager and increase the blind bet by any amount which at least doubles the current blind bet amount—limited only by the number of chips the player has on the table. This is referred to as "doubling up." The player will then receive at least one card, preferably face-up, but may elect to receive more than one card and increase the value of the hand. The "doubling up" differs from standard blackjack wherein the players may "double-down" by increasing their wager only up to the initial wager amount and not over, and the players take one and only one card. The player in connection with the present invention may take this opportunity to signal a strong hand with a very large bet. The hand, however, is not a clear winner because the player can take more than one card and may bust. Additionally, the dealer may also decide that the large bet is a play to induce a dealer surrender and may elect to play a weak hand he otherwise would not have. On the other hand, if the players make aggressive bets, the dealer may be unwilling to risk losing and may surrender. This infuses an additional element of strategy. The players must balance their desire to keep the dealer in the game with winning on a large bet.

Once all of the players have announced their decision on playing their hand, the dealer may re-check his or her down card to determine how to proceed (FIG. 5). In standard blackjack, the dealer has no option of surrender. In the present invention, however, the dealer now has the option of playing the hand or choosing to surrender. The dealer may choose to surrender, based on the dealer's determination that he or she does not have a "good" hand, or is unwilling to risk losing to a large number of players and having to pay out on those player's bets —resulting in depleting all of the dealer chips and forcing the dealer to leave the game. If the dealer surrenders (not shown), the dealer pays half of the player's initial blind bet to each remaining player. Each remaining player will retain their initial blind bet plus receive half of that bet as the price of the dealer surrender. Any player who has already surrendered and forfeited half of their blind bet to the dealer does not receive any winnings. Regardless of the dealer's decision, all of the players' cards are preferably turned face-up at this point so that all player cards are exposed.

Each player now resolves his or her hand, preferably moving in a clockwise direction, beginning with the player to the dealer's immediate left. As shown by Seat 2 in FIG. 6, if the player did not place an increased wager during the wager adjustment round, the player may elect to either stand on the cards dealt or to receive as many additional cards as desired. Further, even if the player did not increase his or her bet initially, the player may now elect to split as in standard blackjack. If the player splits a pair, the player must place the same total bet on the second hand. The player may now play both hands by receiving unlimited cards. The player may also elect to split again an unlimited number of times, including unlimited splitting of aces. This differs from traditional casino rules where aces may only be split once. When splitting, any two cards valued at 10 may be split (e.g. a King and a Queen or a Ten and a Jack). Hands are preferably resolved in clockwise order. As an option, the house or tournament director may allow a player to split even when the player has insufficient chips to place the same total bet on the second hand. In this instance, the player may be allowed to go "all in" and bet all remaining chips. The determination of whether a player may go "all in" will be made pursuant to house or tournament rules.

Figure 6:
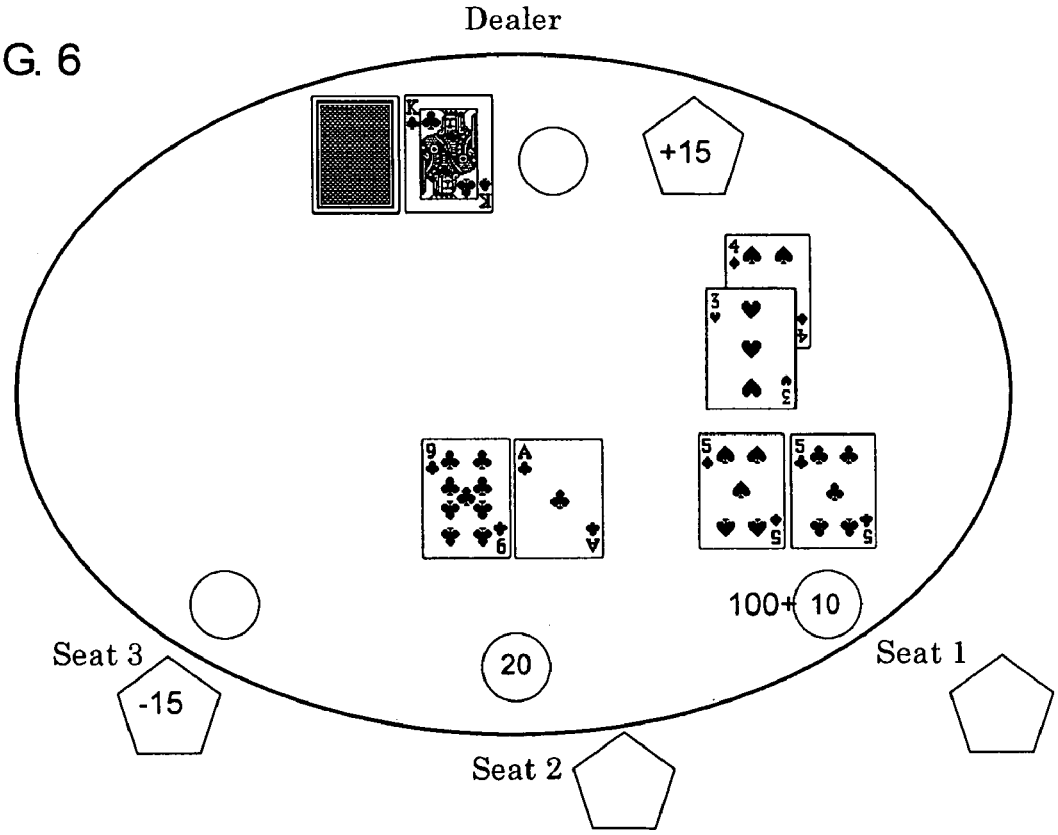
FIG. 6 is a visual representation exemplifying a dealer declaration stage and player resolution stage in the preferred embodiment depicted in FIG. 1.

As shown by Seat 1 in FIG. 6, if the player elected to double-up by placing an increased bet, the player must take at least one card, but may take as many cards as desired. Even if the player has already doubled-up, the player may now elect to additionally split as discussed above. The decision to split, however, is made prior to taking additional cards, with re-splitting allowed if the second card to a new hand also pairs the first.

Figure 7:
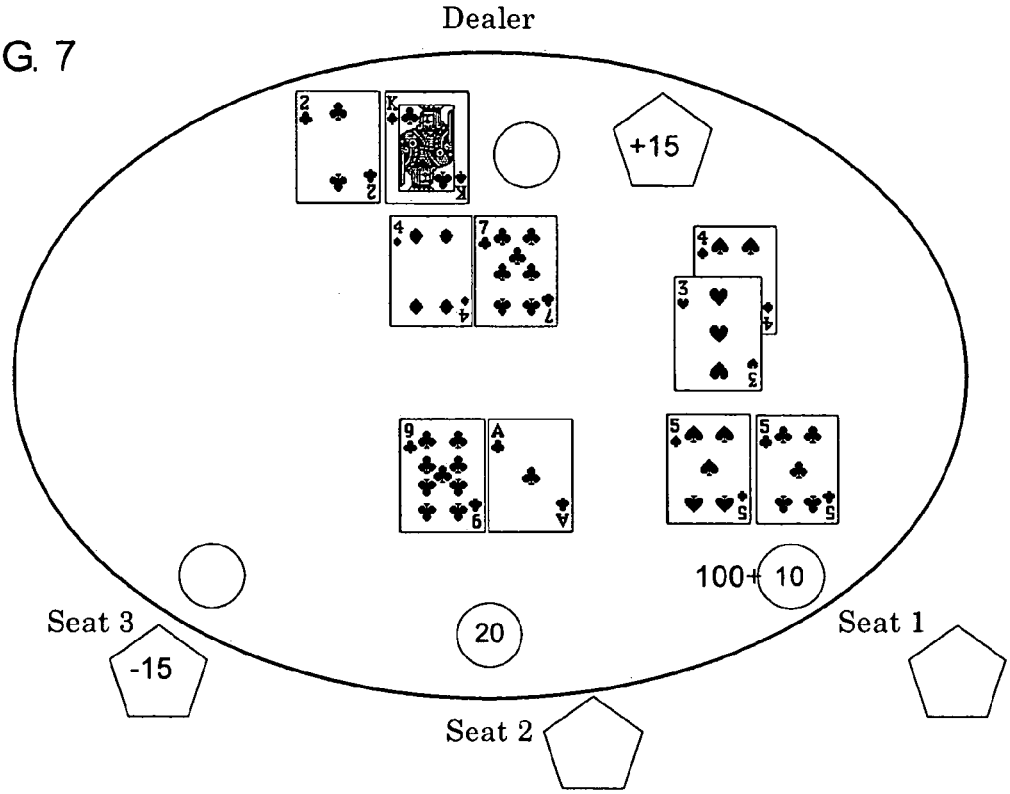
FIG. 7 is a visual representation exemplifying a dealer resolution stage in the preferred embodiment depicted in FIG. 1.

Once all of the players' hands are resolved, the dealer reveals his or her down card and plays out the hand, as shown in FIG. 7. In standard casino-play, the dealer must hit any hand valued at less than 17, and must stay on any hand valued at 17 or over. In addition, some casinos require the dealer to hit a soft 17 while others require the dealer to stand on any 17—the dealer, however, has no discretion to decide. In the present invention, the dealer must hit any hand valued at less than 17 if the hand does not include an ace valued at 11. The dealer has the option to hit any soft hand (any hand containing an ace valued at 11), regardless of the value of the hand. The dealer must stand, however, on any hard 17 or higher (e.g. when an ace is valued as 1 or when there is no ace in the hand).

Once the dealer's hand reaches 17 or higher without counting an ace as 11, the dealer must stand. This gives the players more pause if the dealer has an ace up because the dealer has a better chance of improving a poor hand into a winning hand. An exception to this rule is that when only one player and the dealer remain, the dealer is not forced to stay on a losing hand valued at 17 to 20 and may continue taking cards until the dealer wins, ties or busts. The dealer is not allowed to split or double-down.

Figure 8:
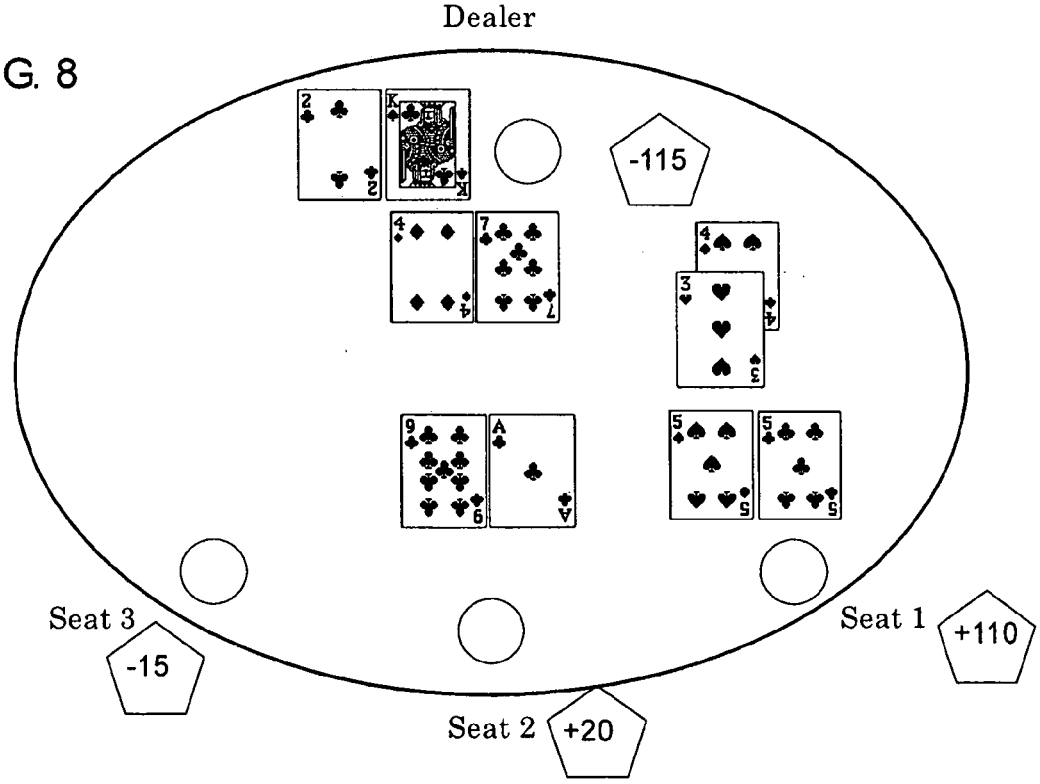
FIG. 8 is a visual representation exemplifying a final wager allocation between the players and the dealer based on the hand resolution in the preferred embodiment depicted in FIG. 1.
Figure 9A:
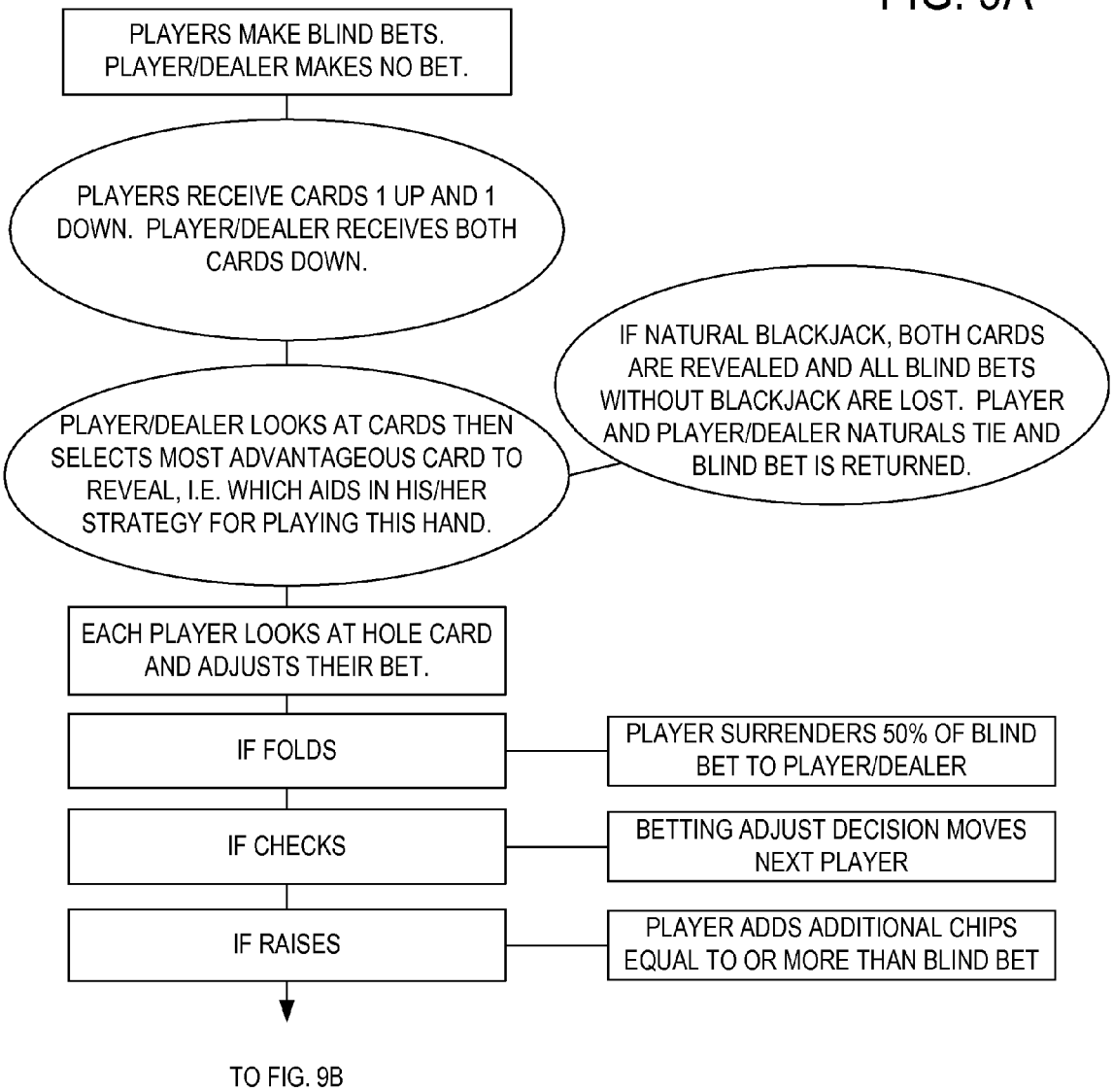
FIGS. 9A and 9B are flow charts exemplifying the method of playing the preferred embodiment of the present invention.
Figure 9B:
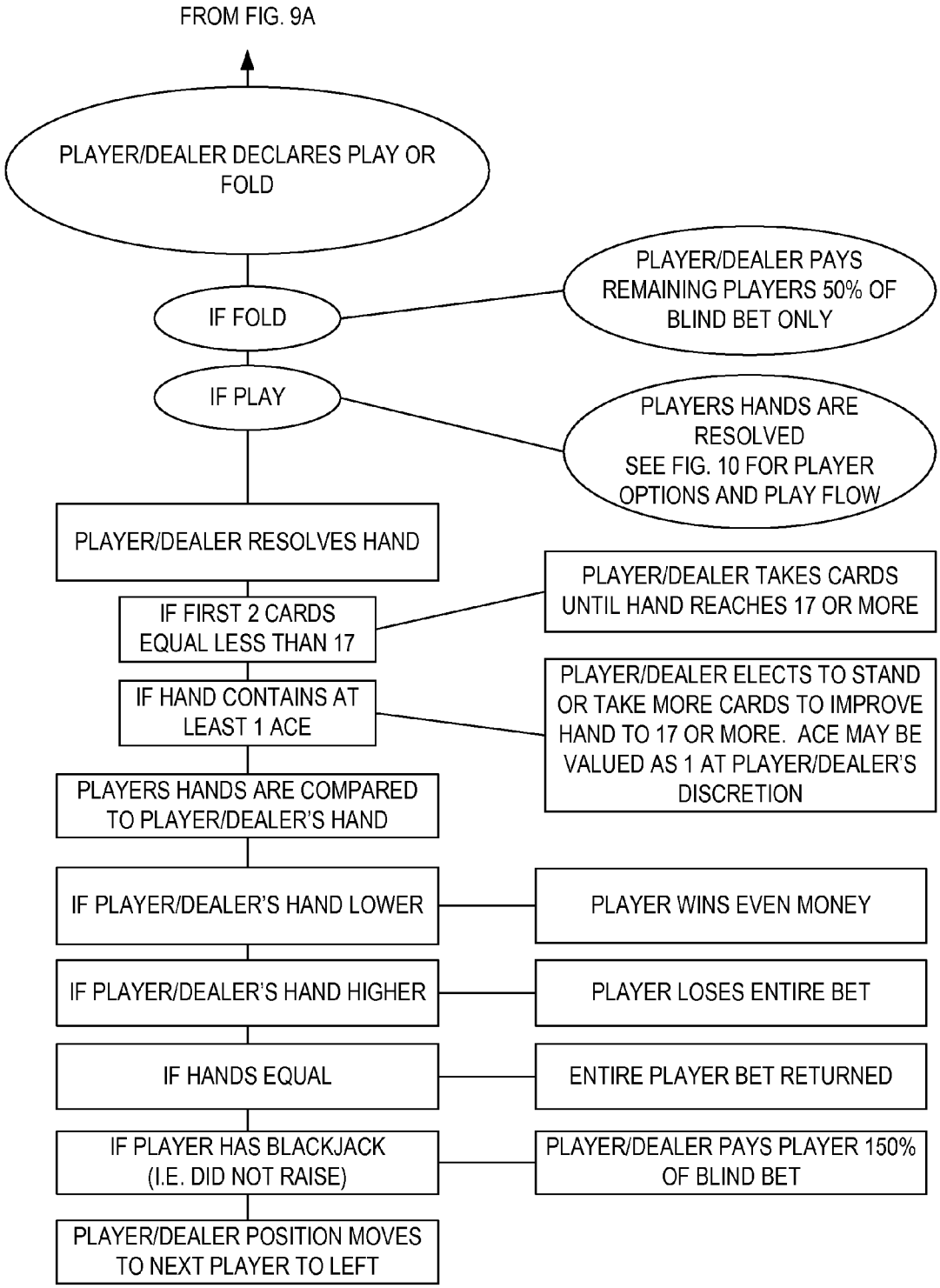
Figure 10:
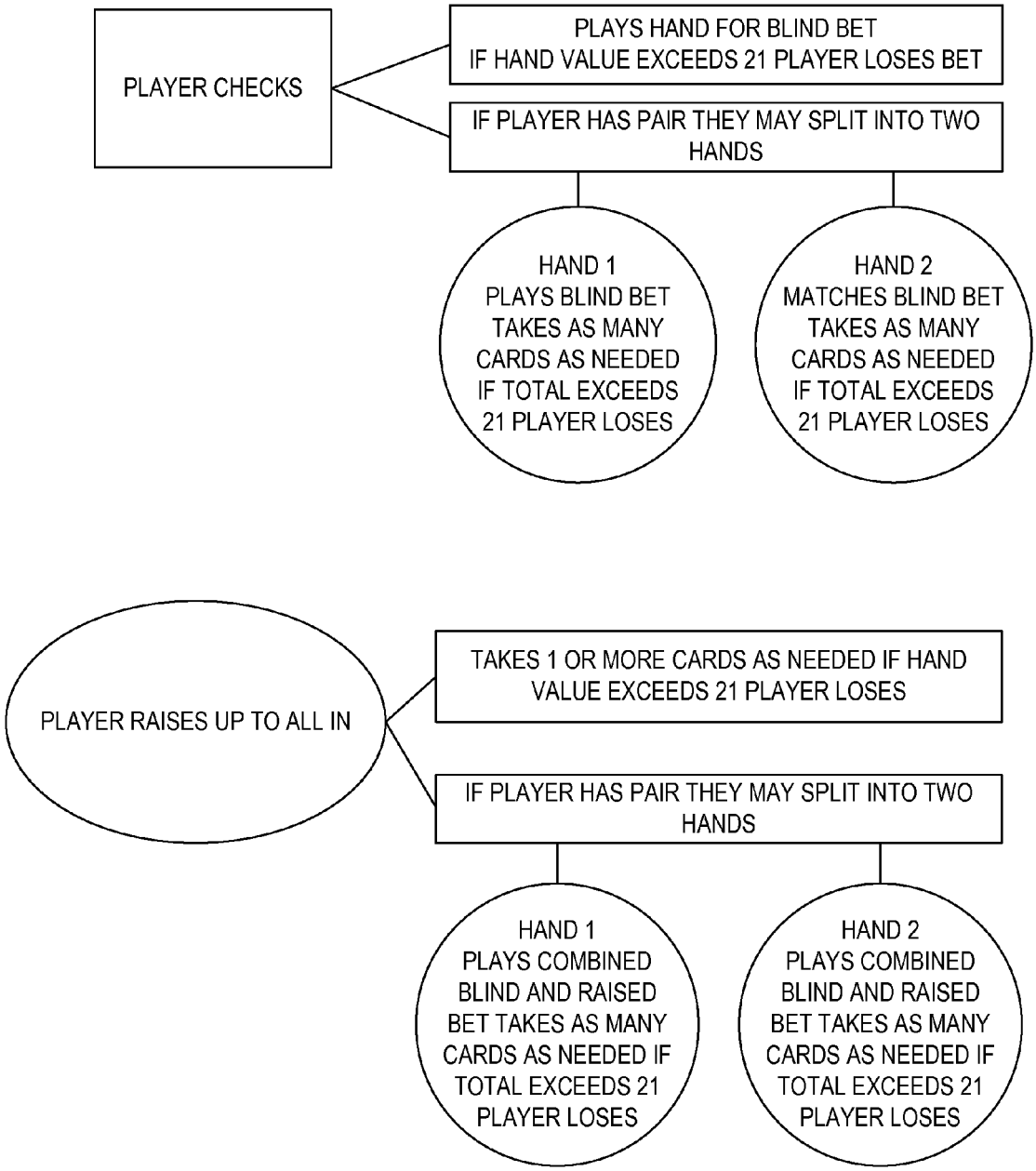
FIGS. 10 is a flow chart exemplifying the method of resolving the players' hands in the preferred embodiment of the present invention.

The determination of winning and losing hands is made as in standard blackjack such that hands totaling 21 or less but exceeding the value of the dealer's hand are winners and the dealer pays the player the amount of his or her total bet. Hands of 21 are paid on the players wager according to pre-set odds. Hands totaling 21 or less but equaling the value of the dealer's hand are a push and the player retains his or her wager. Hands exceeding 21 are a bust and the entire wager goes to the dealer. Hands totaling less than 21, but also being less than the value of the dealer's hand lose and the entire wager goes to the dealer. As shown in FIG. 8, the dealer collects all losing bets and then pays off all winning bets beginning with the player to the immediate left of the dealer. Preferably, as in standard blackjack, a winning hand is paid at 1:1 and a blackjack is paid at 3:2. Of course, these pre-set odds may be altered by the house, host or tournament director and still fall within the scope of the present invention.

If a dealer or player runs out of chips, he or she must leave the game. The game is preferably a table stakes game, meaning that additional chips may not be purchased during the game and each player is limited to the number of chips on the table. If the dealer runs out of chips, the player's initial blind bets are paid first and any increased bets are paid last.

In another embodiment, rebuys may be allowed—meaning that additional chips may be purchased at the table. If this is the case and the dealer runs out of chips, he or she must purchase enough chips to pay off all winning players before continuing to play the game. If rebuys are allowed, the dealer may also decline to rebuy and must then leave the game. In yet another embodiment, if rebuys are not allowed and the dealer does not believe he or she will have enough chips to cover winning bets, he or she may pass the deal to the next player.

If the dealer has sufficient chips to pay off one minimum wager, the players to the dealer's immediate left must play. Once the blind wagers of the players reaches the total of the dealer's chips, subsequent players may sit out the hand or elect to play in the hope that enough other players will lose, which will allow the dealer to pay off subsequent wagers. In yet another embodiment, if the players do not believe the dealer has sufficient chips to cover their wagers, they may decline to play the hand.

The cards are preferably dealt from a two-deck shoe. However, single deck and larger shoe games are allowed. All cards, including folded hands, will be exposed for at least 5 seconds at the end of the hand in order to allow and even encourage card counting. In standard casino play, card counting is considered cheating. In Nevada, while card counters may not be barred unless using mechanical devices to keep count, once identified, counter measures such as frequent shuffles are employed to encourage the card counter to leave the game. The present invention pits strong poker players against strong blackjack players because the skills offset the chance element in play.

The blackjack game of the present invention can be played live in a casino, in a tournament setting or in private games. The blackjack game of the present invention can also be played on-line against other players and on casino-based video gaming machines.

From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A method of playing a modified version of Blackjack, comprising:

Providing one or more standard decks of playing cards, each deck containing 52 cards and each card having a specific numeric value;

One or more players making a blind wager prior to any cards being dealt to be eligible to play a hand;

A dealer dealing an initial hand of two cards to each of the players and two cards to the dealer, the dealer's cards being dealt face down, wherein each player and the dealer obtains an initial card sum according to a schedule;

Thereafter, the dealer reviewing the numerical values of the dealer cards and then selecting which of said two dealer cards to turn face up;

Thereafter, each player declaring said player's hand either as a surrender wherein said player must withdraw from play, as a playing hand, or as an increased wager hand wherein said player must make an additional wager;

After all players have declared their hands, the dealer declaring the dealer's hand either as a surrender or as a playing hand, wherein the dealer's declaring is based on a discretionary election by the dealer;

If dealer surrenders, dealer paying half of each remaining player's blind wager to said player or, if player's initial card sum equals 21, the dealer paying pre-set odds on the player's blind wager to said player;

The dealer dealing additional cards to each player upon said player's request, wherein each player elects in turn to stand or receive additional cards one at a time until the player elects to receive no more or until the card sum exceeds 21, with the final number of cards held by each player comprising said player's hand and final card sum;

If a player's final card sum exceeds 21, said player forfeiting the player's wager to the dealer and withdrawing from play;

The dealer dealing additional cards to the dealer when the dealer's card sum is less than 17 and the dealer's hand does not contain an ace valued at a value of 11;

The dealer dealing additional cards to the dealer upon dealer's request, provided dealer's card sum is less than 21 and the dealer's hand contains an ace valued at a value of 11, with the final number of cards held by the dealer comprising the dealer's hand and final card sum;

Comparing each player's final card sum to the dealer's final card sum, wherein a player has a winning hand if player's final card sum is 21 and dealer's final card sum is not 21 or if player's final card sum is less than 21 and closer to 21 than dealer's final card sum or if player's final card sum is equal to or less than 21 and dealer's final card sum exceeds 21;

a player has a losing hand if player's final card sum exceeds 21 or is further from 21 than dealer's final card sum, and a player ties with the dealer where player's final card sum is equal to dealer's final card sum;

The dealer collecting a player's wagers if said player has a losing hand;

A player retaining said player's wagers if the player ties with dealer; and

The dealer paying winnings to a player based on said player's wager and pre-set odds if the player has a winning hand.

2. The method of claim 1, wherein the initial and final player and dealer card sums comprises adding the point value for each card, wherein numbered cards are worth their face value, face cards are worth ten and aces are worth one or eleven.

3. The method of claim 1, wherein a limit is placed on the blind wager.

4. The method of claim 3, wherein a minimum blind wager is established and each player may place a blind wager as a 1×, 2× or 3× multiple of said minimum wager.

5. The method of claim 1, wherein the increased wager at least doubles the player's initial blind wager.

6. The method of claim 1 or 5, wherein a player making an increased wager must take at least one additional card, but may take additional cards until the player elects to receive no more or until the card sum exceeds 21.

7. The method of claim 1, further comprising determining after the initial hand is dealt if dealer's card sum or any player's card sum equals 21 and, if dealer's card sum equals 21, the dealer collecting the blind wager of any player not having a card sum equal to 21.

8. The method of claim 1, further comprising a player paying half of said player's blind wager to dealer if said player declares a surrender.

9. The method of claim 1, further comprising the role of dealer rotating between the players.

10. The method of claim 1, further comprising offering each player, in turn, the role of dealer until a player accept the dealer role, wherein said accepting player is designated as the dealer.

11. The method of claim 1, wherein all cards dealt are exposed at the end of every hand.

12. The method of claim 1, wherein a player's initial two cards are dealt one card face up and one card face down.

13. The method of claim 1, wherein two cards are dealt in succession to each player and then to dealer.

14. The method of claim 1, wherein one card is dealt to each player and dealer and a second card is then dealt to each player and dealer in a second pass around the table.

15. The method of claim 1, wherein a player selects which of the initial hand of two cards to place face-up.

16. The method of claim 1, wherein all wagers are paid and collected in the form of chips and wherein if dealer runs out of chips while paying winnings to players, a player's initial blind wager is paid out first, followed by said player's increased wager, if any.

17. A method of playing a modified version of Blackjack, comprising:

Providing one or more standard decks of playing cards, each deck containing 52 cards and each card having a specific numeric value;

One or more players making a blind wager of 1×, 2× or 3× an established minimum wager prior to any cards being dealt to be eligible to play a hand;

A dealer dealing an initial hand of two cards to each of the players and two cards to the dealer, the dealer's cards being dealt face down, wherein each player and the dealer obtains an initial card sum;

Thereafter, the dealer reviewing the numerical values of the dealer cards and then the dealer selecting which of said two dealer cards to turn face up;

Thereafter, each player declaring said player's hand either as a surrender wherein said player must withdraw from play, as a playing hand, or as an increased wager hand wherein said player must make an additional wager at least equal to the player's initial blind wager;

After all players have declared their hands, the dealer declaring the dealer's hand either as a surrender or as a playing hand wherein the dealer's declaring is based on a discretionary election by the dealer;

If dealer surrenders, dealer paying half of each remaining player's blind wager to said player or, if player's initial card sum equals 21, the dealer paying pre-set odds on the player's blind wager to said player;

The dealer dealing additional cards to each player upon said player's request, wherein each player elects in turn to stand or receive additional cards one at a time until the player elects to receive no more or until the card sum exceeds 21, with the final number of cards held by each player comprising said player's hand and final card sum;

If a player's final card sum exceeds 21, said player forfeiting the player's wager to the dealer and withdrawing from play;

The dealer dealing additional cards to the dealer when the dealer's card sum is less than 17 and the dealer's hand does not contain an ace valued at a value of 11;

The dealer dealing additional cards to the dealer upon dealer's request, provided dealer's card sum is less than 21 and the dealer's hand contains an ace valued at a value of 11, with the final number of cards held by the dealer comprising the dealer's hand and final card sum;

Comparing each player's final card sum to the dealer's final card sum, wherein a player has a winning hand if player's final card sum is 21 and dealer's final card sum is not 21 or if player's final card sum is less than 21 and closer to 21 than dealer's final card sum or if player's final card sum is equal to or less than 21 and dealer's final card sum exceeds 21, a player has a losing hand if player's final card sum exceeds 21 or is further from 21 than dealer's final card sum, and a player ties with the dealer where player's final card sum is equal to dealer's final card sum;

The dealer collecting a player's wagers if said player has a losing hand;

A player retaining said player's wagers if the player ties with dealer;

The dealer paying winnings to a player based on said player's wager and pre-set odds if the player has a winning hand; and Exposing all cards dealt at the end of the hand.

18. A method of playing a modified version of Blackjack, comprising:

Providing one or more standard decks of playing cards, each deck containing 52 cards and each card having a specific numeric value;

One or more players making a blind wager prior to any cards being dealt to be eligible to play a hand;

A dealer taking an active role in dealing and playing the hand;

The dealer dealing an initial hand of two cards to each of the players and two cards to the dealer, the dealer's cards being initially dealt face down, wherein each player and the dealer obtains an initial card sum;

The dealer reviewing the numerical values of the two dealer cards and then selecting which of said two dealer cards to turn face up;

After one of the two dealer cards is turned face up, each player declaring said player's hand either as a surrender wherein said player must withdraw from play, as a playing hand, or as an increased wager hand wherein said player must make an additional wager;

After each player declaring said player's hand, the dealer electing to surrender or play the hand based on a discretionary decision by the dealer;

The dealer dealing additional cards to each player upon said player's request, wherein each player elects in turn to stand or receive additional cards one at a time until the player elects to receive no more or until the card sum exceeds 21, with the final number of cards held by each player comprising said player's hand and final card sum;

If a player's final card sum exceeds 21, said player forfeiting the player's wager to the dealer and withdrawing from play;

The dealer dealing additional cards to the dealer when the dealer's card sum is less than 17 and the dealer's hand does not contain an ace valued at a value of 11, with the final number of cards held by the dealer comprising the dealer's hand and final card sum;

Comparing each player's final card sum to the dealer's final card sum, wherein a player has a winning hand if player's final card sum is 21 and dealer's final card sum is not 21 or if player's final card sum is less than 21 and closer to 21 than dealer's final card sum or if player's final card sum is equal to or less than 21 and dealer's final card sum exceeds 21, a player has a losing hand if player's final card sum exceeds 21 or is further from 21 than dealer's final card sum, and a player ties with the dealer where player's final card sum is equal to dealer's final card sum;

The dealer collecting a player's wagers if said player has a losing hand;

A player retaining said player's wagers if the player ties with dealer; and

The dealer paying winnings to a player based on said player's wager and pre-set odds if the player has a winning hand.

19. The method of claim 18, wherein the dealer has the option of receiving additional cards if the dealer's hand contains an ace valued at a value of 11.

20. The method of claim 1, 17 or 18, wherein the dealer has the option of taking additional cards on any losing dealer hand regardless of the dealer's card sum when the dealer and one and only one player remain in the game.

21. A method of playing a modified version of Blackjack in a casino, comprising:

Playing a game of blackjack;

A player in the game assuming the role of dealer;

The dealer dealing an initial hand of two cards to each player and two cards to the dealer, wherein the two dealer cards being dealt face down; and The dealer taking an active decision-making role in dealing and playing the hand, wherein the dealer selects at the dealer's discretion which of the two dealer down cards to expose after reviewing numerical values of the two dealer down cards.

22. The method of claim 21, wherein the dealer has the option to surrender or play a hand based on the dealer's discretion.

23. The method of claim 21, wherein the dealer has the option, based on the dealer's discretion of receiving additional cards if the dealer's hand contains an ace valued at a value of 11.

24. The method of 21 wherein,

One or more players making a blind wager during an initial wager round prior to any cards being dealt; and One or more players having the option to participate in a wager adjustment round after all cards have been dealt, wherein each player may place an additional wager at least equal to that player's initial blind wager wherein each player placing an additional wager must take at least one additional card from the dealer, but may take as many additional cards as desired.

* * * * *